US009324285B2

(12) United States Patent
Furihata

(10) Patent No.: US 9,324,285 B2
(45) Date of Patent: Apr. 26, 2016

(54) APPARATUS FOR SIMULTANEOUSLY PERFORMING GAMMA CORRECTION AND CONTRAST ENHANCEMENT IN DISPLAY DEVICE

(75) Inventor: Hirobumi Furihata, Kanagawa (JP)

(73) Assignee: Renesas Electronics Corporation, Kawasaki, Kanagawa (JP)

( * ) Notice: Subject to any disclaimer, the term of this patent is extended or adjusted under 35 U.S.C. 154(b) by 941 days.

(21) Appl. No.: 12/926,679

(22) Filed: Dec. 3, 2010

(65) Prior Publication Data

US 2011/0134152 A1 Jun. 9, 2011

(30) Foreign Application Priority Data

Dec. 8, 2009 (JP) ..... 2009-278884

(51) Int. Cl.
*G09G 5/10* (2006.01)
*G09G 3/36* (2006.01)

(52) U.S. Cl.
CPC ..... *G09G 3/3648* (2013.01); *G09G 2320/0276* (2013.01); *G09G 2320/066* (2013.01); *G09G 2320/0673* (2013.01)

(58) Field of Classification Search
CPC ..... G09G 3/3611; G09G 3/3648; G09G 5/02; H04N 5/2355
USPC ..... 345/89, 104, 690, 691
See application file for complete search history.

(56) References Cited

U.S. PATENT DOCUMENTS 5,394,195 A * 2/1995 Herman ..... 348/675
7,312,776 B2 * 12/2007 Bu ..... 345/88
7,466,296 B2 * 12/2008 Bu ..... 345/89
7,755,640 B2 * 7/2010 Huang et al. ..... 345/600
7,973,973 B2 7/2011 Nose et al.
8,248,493 B2 * 8/2012 Higashi ..... 348/254
8,355,163 B2 * 1/2013 Udagawa et al. ..... 358/1.9
8,477,247 B2 * 7/2013 Sarkar et al. ..... 348/649
2007/0013979 A1 1/2007 Nose et al.
2007/0268524 A1 * 11/2007 Nose et al. ..... 358/3.01

(Continued)

FOREIGN PATENT DOCUMENTS

CN 101075415 A 11/2007
JP 8-186724 A 7/1996

(Continued)

OTHER PUBLICATIONS

Japanese Office Action dated Jan. 9, 2013, with partial English translation.

(Continued)

*Primary Examiner* — Calvin C Ma
(74) *Attorney, Agent, or Firm* — McGinn IP Law Group, PLLC

(57) ABSTRACT

A display device is provided with a display panel; a correction circuit which performs gamma correction on target image data in response to correction data specifying a gamma curve; and a driver circuit driving the display panel in response to gamma-corrected data received from the correction circuit. The correction circuit is configured to perform approximate gamma correction in accordance with a correction expression in which the target image data is defined as a variable of the correction expression and coefficients of the same are determined on the correction data, and to modify the correction data in response to target image data associated with the target pixel of the gamma correction and the pixel adjacent to the target pixel.

21 Claims, 8 Drawing Sheets

(56) References Cited

U.S. PATENT DOCUMENTS

| | | | | |
|---|---|---|---|---|
| 2008/0204372 | A1* | 8/2008 | Correa et al. | 345/60 |
| 2009/0087016 | A1* | 4/2009 | Berestov et al. | 382/100 |
| 2009/0274368 | A1* | 11/2009 | Watanabe | 382/167 |

FOREIGN PATENT DOCUMENTS

| | | | |
|---|---|---|---|
| JP | 2007-72085 | A | 3/2007 |
| JP | 2007-288484 | A | 11/2007 |
| JP | 2007-310097 | A | 11/2007 |
| JP | 2008-52353 | A | 3/2008 |
| JP | 2008-54267 | A | 3/2008 |

OTHER PUBLICATIONS

Chinese Office Action dated Jan. 2, 2014, with English translation.

* cited by examiner

INPUT IMAGE DATA
32
32
112
192
192
192
OUTPUT DATA
INPUT DATA
32
32
32

APPARATUS FOR SIMULTANEOUSLY PERFORMING GAMMA CORRECTION AND CONTRAST ENHANCEMENT IN DISPLAY DEVICE

INCORPORATION BY REFERENCE

This patent application claims a priority on convention based on Japanese Patent Application No. 2009-278884 filed on Dec. 8, 2009. The disclosure thereof is incorporated herein by reference.

BACKGROUND OF THE INVENTION

1. Field of the Invention

The present invention is related to a display device, a display panel driver and an image data processing unit, more particularly, to a technique for performing image data processing for image contrast enhancement.

2. Description of the Related Art

Output devices, such as display devices and printers, are often configured to perform image processing on image data for improving the image quality. Such image processing may include contrast enhancement and/or edge enhancement. The contrast enhancement is image processing for making the image sharp by brightening bright portions of the image and darken dark portions of the same, and the contrast enhancement is image processing for making the image sharp by steepen the changes in the grayscale levels of portions near edges included in the image. It should be noted here that, since the difference in the grayscale level is large between adjacent pixels in an edge portion of an image, the edge enhancement processing causes the same effect as the contrast enhancement in many images.

Japanese Patent Application publications Nos. H08-186724 A (hereinafter, the '724 application) and 2008-52353 A (hereinafter, the '353 application) disclose image data processing apparatus for contrast enhancement and edge enhancement. The '724 application discloses edge enhancement based on Gaussian filtering. The '353 application discloses edge enhancement based on Laplacian filtering. Japanese Patent Application Publication No. 2008-54267 A also discloses edge enhancement.

The image data apparatuses disclosed in the '724 and '353 applications also perform gamma correction in addition to the edge enhancement. Here, the gamma correction is image processing for correcting externally-supplied image data in accordance with the output characteristics of the output device. Since an output device generally shows non-linear output characteristics, an image is not displayed with a desired color tone by simply outputting the image with output levels (i.e., the voltage levels of drive voltage signals and the current levels of drive current signals) in proportion to the grayscale levels indicated in the image data. Correction of image data in accordance with the output characteristics of the output device allows outputting an image with a desired color tone. For a case where a liquid crystal display panel is used as the output device, for example, an image can be displayed with a desired color tone by correcting the image data in accordance with the voltage-transmittance characteristics (V-T characteristics) of the liquid crystal display panel and generating drive voltages for driving the respective pixels in response to the corrected image data.

SUMMARY OF INVENTION

The inventor has discovered that the image processing apparatuses disclosed in the '724 and '353 applications, however, undesirably requires large hardware, since the edge enhancement and the gamma correction are performed in separate units. According to the inventor's study, use of a calculation circuit which simultaneously performs gamma correction and contrast enhancement effectively reduces the hardware required for the same.

With such technical idea, the inventor has invented circuit architecture which modifies the arithmetic processing in the gamma correction in accordance with the values of image data associated with a target pixel and an pixel adjacent thereto.

In an aspect of the present invention, a display device is provided with a display panel; a correction circuit which performs gamma correction on target image data in response to correction data specifying a gamma curve; and a driver circuit driving the display panel in response to gamma-corrected data received from the correction circuit. The correction circuit is configured to perform approximate gamma correction in accordance with a correction expression in which the target image data is defined as a variable of the correction expression and coefficients of the same are determined on the correction data, and to modify the correction data in response to target image data associated with the target pixel of the gamma correction and the pixel adjacent to the target pixel.

In another aspect of the present invention, a display paned driver is provided with: a correction circuit which performs gamma correction on target image data in response to correction data specifying a gamma curve; and a driver circuit driving a display panel in response to gamma-corrected data received from the correction circuit. The correction circuit is configured to perform approximate gamma correction in accordance with a correction expression in which the target image data is defined as a variable of the correction expression and coefficients of the same are determined on the correction data, and to modify the correction data in response to target image data associated with the target pixel of the gamma correction and the pixel adjacent to the target pixel.

In still another aspect of the present invention, an image data processing unit is provided with a correction unit which performs gamma correction on target image data in response to correction data specifying a gamma curve; and a correction data modification unit. The correction unit is configured to perform approximate gamma correction in accordance with a correction expression in which the target image data is defined as a variable of the correction expression and coefficients of the same are determined on the correction data. The correction data modification unit is configured to modify the correction data in response to target image data associated with the target pixel of the gamma correction and the pixel adjacent to the target pixel.

The present invention allows performing gamma correction and contrast enhancement with reduced hardware.

BRIEF DESCRIPTION OF THE DRAWINGS

The above and other advantages and features of the present invention will be more apparent from the following description taken in conjunction with the accompanied drawings, in which.

DESCRIPTION OF PREFERRED EMBODIMENTS

The invention will be now described herein with reference to illustrative embodiments. Those skilled in the art would recognize that many alternative embodiments can be accomplished using the teachings of the present invention and that the invention is not limited to the embodiments illustrated for explanatory purposed.

First Embodiment

Figure 1:
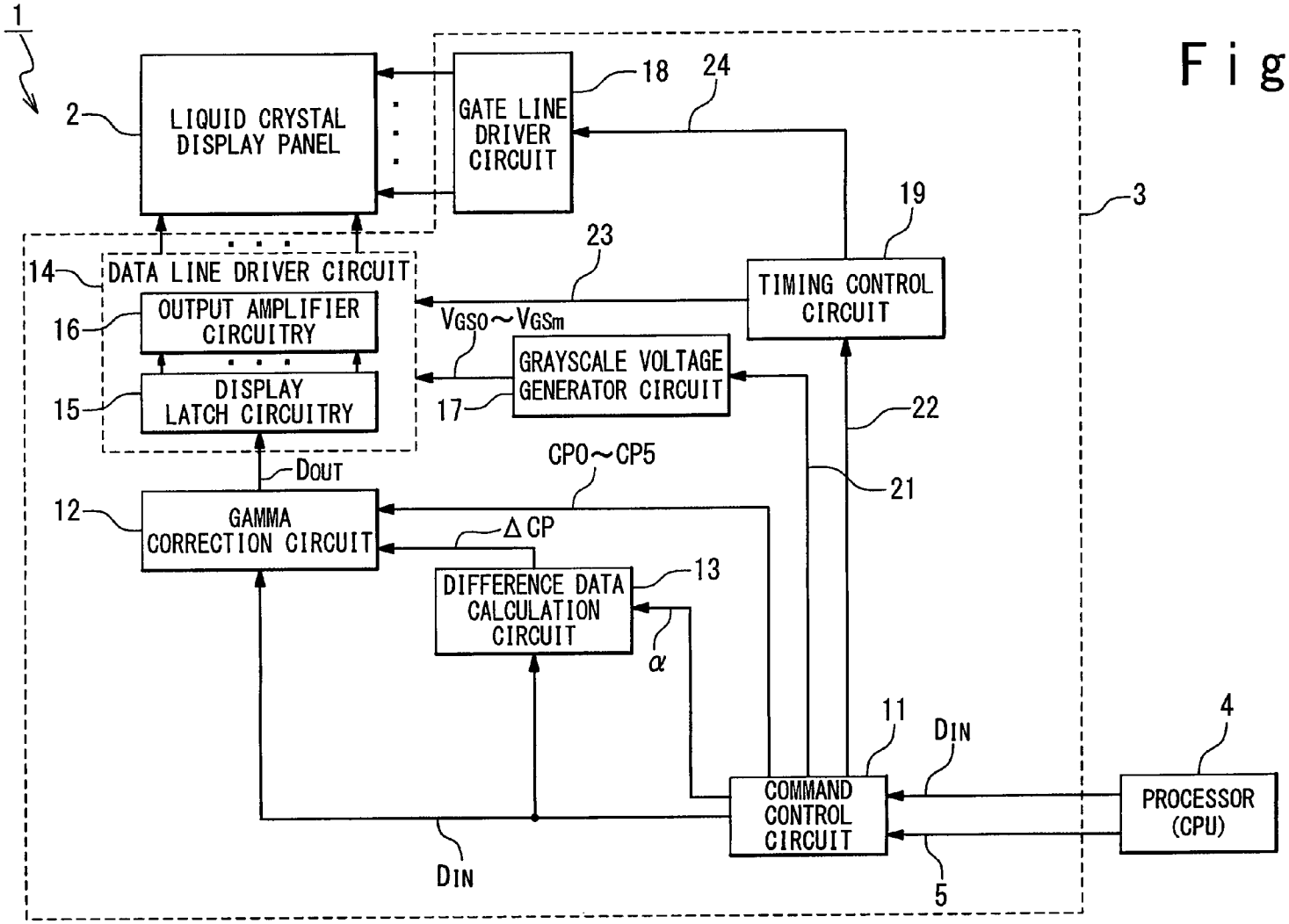
FIG. 1 is a block diagram showing an exemplary configuration of a liquid crystal display device in a first embodiment of the present invention.

FIG. 1 is a block diagram showing an exemplary configuration of a liquid crystal display device 1 in a first embodiment of the present invention. The liquid crystal display device 1 is provided with a liquid crystal display panel 2 and a controller driver 3, and configured to display an image on the liquid crystal panel 2 in response to input image data $D_{IN}$ and control signals 5 received from a processing unit 4. It should be noted here that the input image data $D_{IN}$ are image data of an image to be displayed on the liquid crystal display panel 2; the input image data $D_{IN}$ specify the grayscale levels of respective sub-pixels of respective pixels of the liquid crystal display panel 2. In this embodiment, each pixel is provided with a sub-pixel showing red (R sub-pixel), a sub-pixel showing green (G sub-pixel) and a sub-pixel showing blue (B sub-pixel). In the following, input image data $D_{IN}$ for specifying an R sub-pixel may be referred to as input image data $D_{IN}^{R}$. Correspondingly, input image data $D_{IN}$ for specifying a G sub-pixel and a B sub-pixel may be referred to as input image data $D_{IN}^{G}$ and $D_{IN}^{B}$, respectively. The processing unit 4 may include a CPU (central processing unit) or a DSP (digital signal processor).

The liquid crystal display panel 2 is provided with M scan lines (or gate lines) and 3N signal lines (or source lines), wherein M and N are natural numbers. The R, G and B sub-pixels are provided at intersections of the M scan lines (gate lines) and the 3N signal lines (source lines).

The controller driver 3 receives the input image data $D_{IN}$ from the processing unit 4 and drives the signal lines (source lines) of the liquid crystal display panel 2 in response to the received input image data $D_{IN}$. The controller driver 3 also has a function of driving the scan line of the liquid crystal display panel 2. The operation of the controller driver 3 is controlled on the control signals 5.

In detail, the controller driver 3 is provided with: a command control circuit 11, a gamma correction circuit 12, a difference data calculation circuit 13, a data line driver circuit 14, a grayscale voltage generator circuit 17, a gate line driver circuit 18 and a timing control circuit 19.

The command control circuit 11 forwards the input image data $D_{IN}$ received from the processing unit 4 to the gamma correction circuit 12 and the difference data calculation circuit 13. In addition, the command control circuit 11 has a function of controlling the respective circuits of the controller drive 3 in response to the control signals 5.

More specifically, the command control circuit 11 generates correction point data CP0-CP5 and feeds the generated correction point data CP0-CP5 to the gamma correction circuit 12. It should be noted here that the correction point data CP0-CP5 are data for determining the shape of the gamma curve of the gamma correction achieved by the gamma correction circuit 12, specifying the coordinates of the control points determining the shape of the gamma curve. Since the gamma values of the liquid crystal display panel 2 are different for different colors (that is, the gamma values are different for red (R), green (G) and blue (B)), the control point data CP0-CP5 are selected so as to be different for R, G and B. Hereinafter, the correction point data associated with R, G and B are referred to as correction point data CP0_R-CP5_R, correction point data CP0_G-CP5_G and correction point data CP0_B-CP5_B, respectively.

In addition, the command control circuit 11 feeds adjustment data $\alpha$ to the difference data calculation circuit 13. Here, the adjustment data $\alpha$ are parameters used by the difference data calculation circuit 13 in generating difference data $\Delta CP$ from the input image data $D_{IN}$. Details of the adjustment data $\alpha$ and the difference data $\Delta CP$ will be described later.

Furthermore, the command control circuit 11 controls the grayscale voltage generator circuit 17 by feeding a grayscale setting signal 21 and controls the timing control circuit 19 by feeding a timing setting signal 22.

The gamma correction circuit 12 performs the gamma correction on the input image data $D_{IN}$ to thereby generate output image data $D_{OUT}$. Hereinafter, the output image data $D_{OUT}$ associated with R sub-pixels, G sub-pixels and B sub-pixels may be referred to as output image data $D_{OUT}^{R}$, $D_{OUT}^{G}$ and $D_{OUT}^{B}$, respectively. It should be noted that the shape of the gamma curve used by the gamma correction is specified by the correction point data CP0-CP5 received by the command control circuit 11. In this embodiment, the correction point data CP0-CP5 are each 10-bit data. Specifying the shape of the gamma curve by feeding the correction point data CP0-CP5 from the command control circuit 11 to the gamma correction circuit 12 effectively reduces the amount of the data transferred to the gamma correction circuit 12 and allows quickly switching the gamma curve used for the gamma correction.

In this embodiment, the gamma correction circuit 12 modifies the shape of the gamma curve by modifying some of the correction point data CP0-CP5 (CP1 and CP4 in this embodiment) in response to the difference data $\Delta CP$ to thereby achieve contrast enhancement at the same time. In other words, the gamma correction circuit 12 is configured to simultaneously achieve gamma correction and contrast enhancement. Details of the configuration and operation of the gamma correction circuit 12 are described below.

The difference data calculation circuit 13 generates the difference data $\Delta CP$ from the input image data $D_{IN}$. In generating the difference data $\Delta CP$, the difference data calculation circuit 13 uses the adjustment data $\alpha$ fed from the command control circuit 11. As is the case of the correction point data CP0-CP5, the difference data $\Delta CP$ are generally determined so as to be different for R, G and B. Hereinafter, the difference data ΔCP associated with R sub-pixels, G sub-pixels and B sub-pixels are denoted by symbols ΔCP_R, ΔCP_G and ΔCP_B, respectively. Furthermore, the adjustment data α associated with the R sub-pixels, G sub-pixels and B sub-pixels are denoted by symbols $\alpha^R$, $\alpha^G$ and $\alpha^B$, respectively.

The data line driver circuit 14 drives the data lines of the liquid crystal display panel 2 in response to the output image data $D_{OUT}$ fed from the gamma correction circuit 12. In this embodiment, the data line driver circuit 14 is provided with a display latch circuitry 15 and an output amplifier circuitry 16. The display latch circuitry 15 latches the output image data $D_{OUT}$ from the gamma correction circuit 12 and forwards the latched output image data $D_{OUT}$ to the output amplifier circuitry 16. The output amplifier circuitry 16 drives the data lines of the liquid crystal display panel 2 in response to the associated output image data $D_{OUT}$ received from the display latch circuitry 15. More specifically, the output amplifier circuitry 16 selects associated ones of grayscale voltages $V_{GS0}$-$V_{GSm}$ fed from the grayscale voltage generator circuit 17 in response to the output image data $D_{OUT}^R$ $D_{OUT}^G$ and $D_{OUT}^B$, and drives the associated data lines of the liquid crystal display panel 2 to the selected grayscale voltages. This allows driving the R sub-pixels, G sub-pixels and B sub-pixels of the liquid crystal display panel 2 in response to the output image data $D_{OUT}^R$, $D_{OUT}^G$ and $D_{OUT}^B$, respectively. The grayscale voltages $V_{GS0}$-$V_{GSm}$ are controlled on the grayscale setting signal 21 fed from the command control circuit 11 to the grayscale voltage generator circuit 17.

The gate line driver circuit 17 drives the gate lines of the liquid crystal display panel 2.

The timing control circuit 19 provides timing control of the liquid crystal display device 1 in response to the timing setting signal 22 fed from the command control circuit 11. More specifically, the timing control circuit 19 generates timing control signals 23 and 24 and feeds the generated timing control signals 23 and 24 to the data line driver circuit 14 and the gate line driver circuit 18, respectively. The operation timings of the data line driver circuit 14 and the gate line driver circuit 18 are controlled on the timing control signals 23 and 24, respectively.

Figure 2:
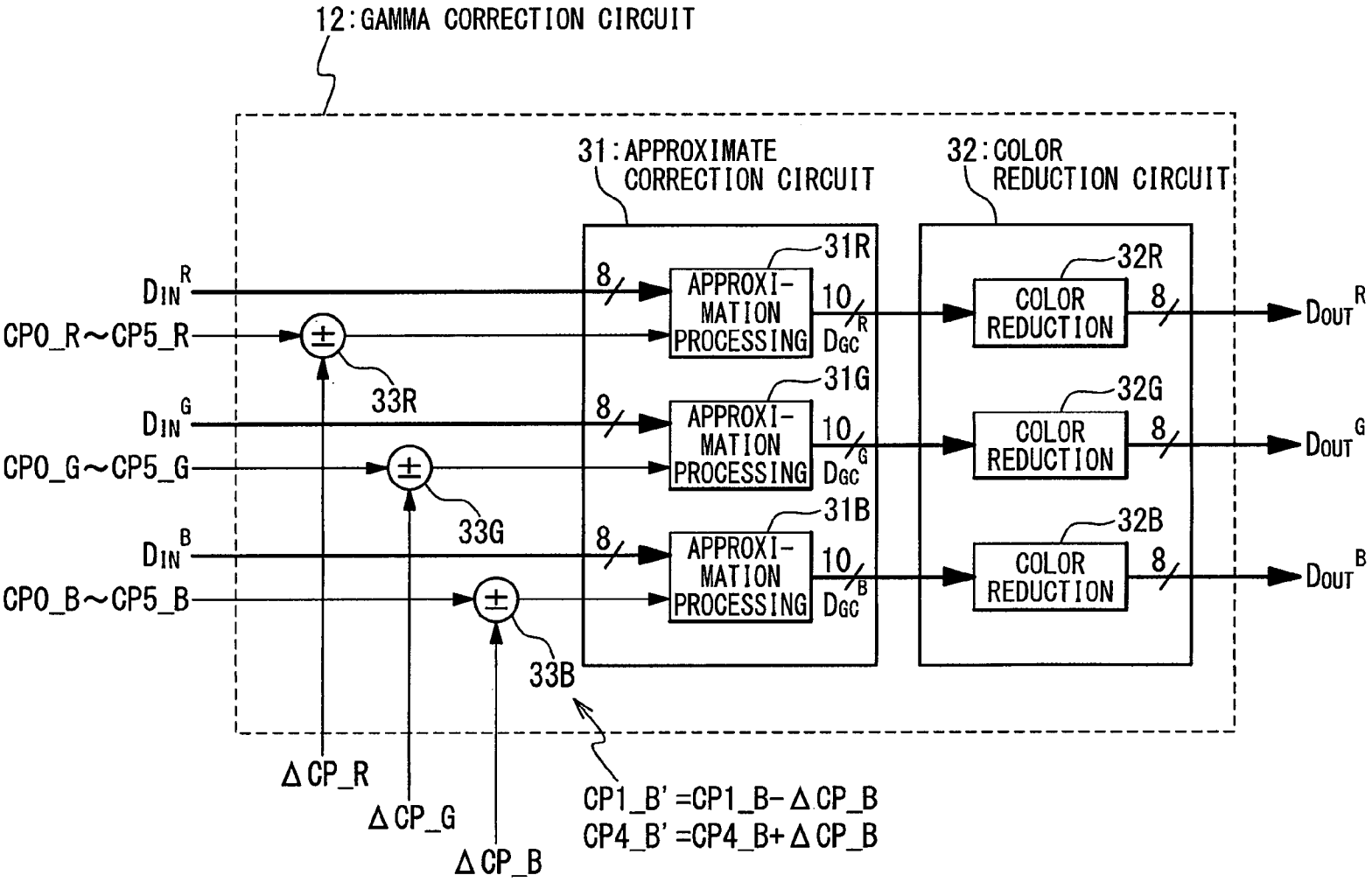
FIG. 2 is a block diagram showing an exemplary configuration of a gamma correction circuit in the first embodiment of the present invention.

FIG. 2 is a block diagram showing an exemplary configuration of the gamma correction circuit 12. The gamma correction circuit 12 is provided with an approximate correction circuit 31, a color reduction circuit 32 and adder-subtracter units 33R, 33G and 33B. The approximate correction circuit 31, which provides gamma correction for the input image data $D_{IN}$, includes approximation processing units 31R, 31G and 31B prepared for R, G and B, respectively. The approximation processing units 31R, 31G and 31B performs gamma correction processing on the input image data $D_{IN}^R$, $D_{IN}^G$ and $D_{IN}^B$, respectively, by using an arithmetic expression, to thereby generate gamma-corrected data $D_{GC}^R$, $D_{GC}^G$ and $D_{GC}^B$, respectively. The coefficients of the arithmetic expression used for the gamma correction by the approximation processing units 31R are determined on the basis of the correction point data CP0_R-CP5_R.

Correspondingly, the coefficients of the arithmetic expression used for the gamma correction by the approximation processing units 31G and 31B are determined on the basis of the correction point data CP0_G-CP5_G and CP0_B-CP5_B, respectively. In the following, the gamma-corrected data $D_{GC}^R$, $D_{GC}^G$ and $D_{GC}^B$ may be collectively referred to as gamma-corrected data $D_{GC}$, if not necessary to distinguish them. The bit width of the gamma-corrected data $D_{GC}$ is larger than that of the input image data $D_{IN}$; in this embodiment, the gamma-corrected data $D_{GC}$ are 10-bit data.

The color reduction circuit 32 provides color reduction for the gamma-corrected image data generated by the approximate correction circuit 32 to thereby generate the resultant output image data $D_{OUT}$. More specifically, the color reduction circuit 32 is provided with color reduction units 32R, 32G and 32B. The color reduction unit 32R performs color reduction processing on the gamma-corrected data $D_{GC}^R$ received from the approximation processing unit 31R, to thereby generate output image data $D_{OUT}^R$. Correspondingly, the color reduction units 32G and 32B perform color reduction processing on the gamma-corrected data $D_{GC}^G$ and $D_{GC}^B$ received from the approximation processing units 31G and 31B, respectively, to thereby generate output image data $D_{OUT}^G$ and $D_{OUT}^B$. In this embodiment, the color reduction units 32R, 32G and 32B each performs 2-bit color reduction. This implies that the output image data $D_{OUT}$ are 8-bit data.

The adder-subtracter units 33R, 33G and 33B modify the correction point data CP1 and CP4, which are used for gamma correction in the approximate correction circuit 31, in response to the difference data ΔCP received from the difference data calculation circuit 13. It should be noted that the correction point data CP1 and CP4 are some of the complete set of the correction point data CP0-CP5 received from the command control circuit 11. The correction point data actually used in the approximation processing units 31R, 31G and 31B of the approximate correction circuit 31 are the data modified by the adder-subtracter units 33R, 33G and 33B.

One feature of the liquid crystal display device 1 of this embodiment is that the gamma correction and the contrast enhancement are simultaneously achieved in the approximate correction circuit 31. More specifically, the gamma correction and the contrast enhancement are simultaneously achieved by modifying the shape of the gamma curve used in the gamma correction of the input image data $D_{IN}$ of a specific pixel in response to the difference between the values of the input image data $D_{IN}$ of the specific pixel and the adjacent pixel. The modification of the shape of the gamma curve is achieved by modifying the values of the correction point data CP1 and CP4 in response to the difference between the values of the input image data $D_{IN}$ of the specific pixel and the adjacent pixel. The use of such approach in achieving the gamma correction and the contrast enhancement effectively reduces the hardware.

In the following, a detailed description is given of the gamma correction and the contrast enhancement in this embodiment. First, a description is given of a basic concept of the gamma correction based on the correction point data CP0-CP5 performed in the approximate correction circuit 31, which is followed by a description of the contrast enhancement based on the modification of the correction point data CP1 and CP4.

1. Gamma Correction Operation

In this embodiment, the gamma correction processing is performed in accordance with the voltage-transmittance characteristics (the V-T characteristics) of the liquid crystal display panel 2. Strictly, the gamma correction processing is represented by the following expression (1):

$$D_{GC}=D_{GC}^{MAX}(D_{IN}/D_{IN}^{MAX})^{\gamma}, \quad (1)$$

where $D_{IN}^{MAX}$ is the maximum value of the input image data, $D_{GC}^{MAX}$ is the maximum value of the gamma-corrected data, and γ is the gamma value; the gamma value γ is a parameter specifying the shape of the gamma curve, determined in accordance with the voltage-transmittance characteristics of the liquid crystal display panel 2.

A strict gamma correction is achieved by directly performing the calculation of Expression (1); processing based on the calculation of Expression (1) involves calculation of a power function. A circuit which strictly performs calculation of a power function is inevitably complex in the configuration and causes a problem when being integrated within the controller driver 3. Although calculation of a power function can be strictly achieved by a combination of calculations of the natural logarithm, multiplication, and the exponential function in a device with a superior computing power, such as a CPU (central processing unit), it is unpreferable in terms of hardware reduction to integrate a circuit which strictly performs an exponential function calculation within a control driver.

On the basis of such background, the gamma correction processing is "approximately" achieved by using an approximate expression in this embodiment. The term "approximately" means that the gamma correction processing is performed by using an approximate expression more suitable for actual implementation. In this gamma correction processing, the shape of the gamma curve is specified by the correction point data CP0-CP5.

In this embodiment, the approximate expression used for the gamma correction processing is switched schematically depending on two parameters: The first parameter is the value of the input image data $D_{IN}$. The allowed value range of the input image data $D_{IN}$ is divided into a plurality of value ranges and different expressions are used for different value ranges; this allows achieving the gamma correction more accurately. The second parameter is the gamma value γ of the gamma correction to be achieved. The shape of the gamma curve varies depending on the gamma value. Selection of the expression in accordance with the gamma value γ allows achieving the gamma correction more accurately, approximately representing the shape of the gamma curve.

More specifically, the expression used for the gamma correction is selected from a plurality of expressions on the basis of (a) whether the input image data $D_{IN}$ is larger than an intermediate data value $D_{IN}^{Center}$ and (b) whether the gamma value γ of the gamma correction to be achieved is less than one, where the intermediate value $D_{IN}^{Center}$ is defined with the allowed maximum value $D_{IN}^{MAX}$ of the input image data $D_{IN}$ by the following expression:

$$D_{IN}^{Center}=D_{IN}^{MAX}/2. \tag{2}$$

The gamma value γ is specified with the control signals 5 by the processing unit 4. The command control circuit 11 selects the expression used for the gamma correction in response to the gamma value γ specified with the control signals 5 and feeds the correction point data CP0-CP5 adapted to the selected expression.

Figure 3:
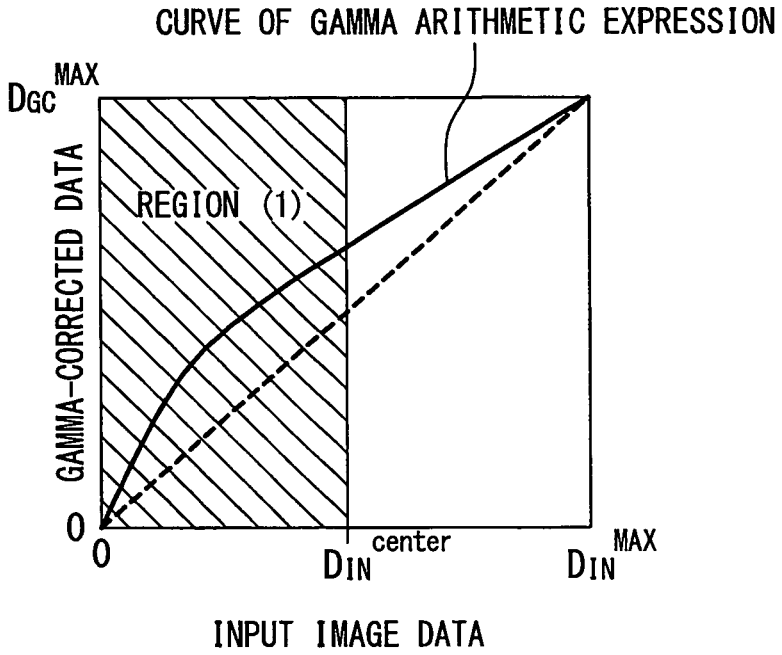
FIG. 3 is a block diagram showing a region in which an arithmetic expression to be used for gamma correction is switched in the first embodiment.

Referring to FIG. 3, for a case where the input image data $D_{IN}$ is smaller than the intermediate data value $D_{IN}^{Center}$, and the gamma value γ of the gamma correction to be achieved is less than one (that is, for the approximation of the gamma curve in the region (1)), an expression which has a term proportional to the input image data $D_{IN}$ to the power of $n_1$ ($0<n_1<1$) and does not have a term proportional to the input image data $D_{IN}$ to the power of $n_2$ ($n_2>1$). In this embodiment, an expression is used which has a term proportional to the input image data $D_{IN}$ to the power of one half. Otherwise, an expression which has a term proportional to the input image data $D_{IN}$ to the power of $n_2$ ($n_2>1$) and does not have a term proportional to the input image data $D_{IN}$ to the power of $n_1$ ($0<n_1<1$) is used for the gamma correction. In this embodiment, an expression is used which has a term proportional to the input image data $D_{IN}$ to the second power.

Such selection of the expression is based on the fact that the expression suitable for the approximation of the gamma curve for a gamma value γ more than one is different from the expression suitable for the approximation of the gamma curve for a gamma value γ less than one. A gamma curve with a gamma value γ more than one can be almost accurately approximated with a quadratic expression, for example; however, a quadratic expression is not suitable for approximating the gamma curve for a gamma value less than one. The use of a quadratic expression causes a serious problem of an increased error from the strict expression, especially in a case where the value of the input image data $D_{IN}$ is close to zero. The use of an expression having a term proportional to the input image data $D_{IN}$ to the power of $n_1$ ($0<n_1<1$), preferably to the power of one half, allows approximation of the gamma curve for a gamma value less than one with a reduced error.

More specifically, the gamma-corrected data $D_{GC}$ are calculated in accordance with the following expressions in this embodiment:

(1) When the input image data $D_{IN}$ are smaller than the intermediate data value $D_{IN}^{Center}$ and the gamma value γ is less than one, $$D_{GC}=\frac{2(CP1-CP0)\cdot PD_{INS}}{K^2}+\frac{(CP3-CP0)D_{INS}}{K}+CP0. \tag{3a}$$

(2) When the input image data $D_{IN}$ are smaller than the intermediate data value $D_{IN}^{Center}$ and the gamma value γ is more than one, $$D_{GC}=\frac{2(CP1-CP0)\cdot ND_{INS}}{K^2}+\frac{(CP3-CP0)D_{INS}}{K}+CP0. \tag{3b}$$

(3) When the input image data $D_{IN}$ are equal to or larger than the intermediate data value $D_{IN}^{Center}$, $$D_{GC}=\frac{2(CP4-CP2)\cdot ND_{INS}}{K^2}+\frac{(CP5-CP2)D_{INS}}{K}+CP2. \tag{3c}$$

It should be noted the parameters K, $D_{INS}$/$PD_{INS}$ and $ND_{INS}$ used in Expressions (3a) to (3C) are defined as follows:

(1) K

The parameter K is given by the following expression:

$$K=(D_{IN}^{MAX}+1)/2. \tag{4}$$

It should be noted that K is a number of two to the power of n, where n is an integer more than one. The maximum value $D_{IN}^{MAX}$ of the input image data $D_{IN}$ is a value obtained by subtracting one from a certain number expressed as two to the power of n. For a case where input image data $D_{IN}$ are 6-bit data, for example, the maximum value $D_{IN}^{MAX}$ is 63. The parameter K given by Expression (4) is therefore expressed as two to the power of n. This advantageously allows calculations of Expression (3a) to (3c) with a simply configured circuit. The division by a number of two to the power of n can be easily achieved by a right shift circuit. Although Expressions (3a) to (3c) involve divisions by K, these divisions can be achieved by a simply-configured circuit, since the K is a number expressed by two to the power of n.

(2) $D_{INS}$ $D_{INS}$ is dependent on the input image data $D_{IN}$ and expressed by the following expression:

$$D_{INS}=D_{IN}(\text{for } D_{IN}<D_{IN}^{Center}), \tag{5a}$$

$$D_{INS}=D_{IN}+1-K(\text{for } D_{IN}>D_{IN}^{Center}) \tag{5b}$$

(3) $PD_{INS}$ $PD_{INS}$ is defines by the following expression (6a) with a parameter R defined by Expression (6b):

$$PD_{INS}=(K-R)\cdot R, \tag{6a}$$

$$R=K^{1/2}\cdot(D_{IN})^{1/2}. \tag{6b}$$

As is understood from Expressions (6a) and (6b), the parameter R is a value proportional to $D_{IN}$ to the power of one half, and therefore $PD_{INS}$ is a value calculated with an expression including a term proportional to the input image data $D_{IN}$ to the power of one half and a term proportional to the input image data $D_{IN}$ to the first power.

(4) $ND_{INS}$ $ND_{INS}$ is given by the following expression:

$$ND_{INS}=(K-D_{INS})\cdot D_{INS}. \tag{7}$$

As understood from Expressions (7), (5a) and (5b), $ND_{INS}$ is a value calculated with an expression including a term proportional to the input image data $D_{IN}$ to the second power.

As described above, CP0 to CP5 are correction point data received from the command control circuit 11 which are used to determine the shape of the gamma curve. In order to perform gamma correction in the controller driver 3 in accordance with the gamma value γ received from the command control circuit 11, the correction point data CP0-CP5 are determined as follows:

(1) For γ<1, $$\begin{aligned} CP0 &= 0, \\ CP1 &= \frac{4\cdot\mathrm{Gamma}[K/4]-\mathrm{Gamma}[K]}{2}, \\ CP2 &= \mathrm{Gamma}[K-1], \\ CP3 &= \mathrm{Gamma}[K], \\ CP4 &= 2\cdot\mathrm{Gamma}[(D_{IN}^{MAX}+K-1)/2]-D_{GC}^{MAX}, \\ CP5 &= D_{GC}^{MAX}. \end{aligned} \tag{8a}$$

(2) For γ>1, $$\begin{aligned} CP0&=0, \\ CP1&=\mathrm{Gamma}[K/2]-\mathrm{Gamma}[K], \\ CP2&=\mathrm{Gamma}[K-1], \\ CP3&=\mathrm{Gamma}[K], \\ CP4&=2\cdot\mathrm{Gamma}[(D_{IN}^{MAX}+K-1)/2]-D_{GC}^{MAX}, \\ CP5&=D_{GC}^{MAX}. \end{aligned} \tag{8b}$$

Note that Gamma[x] is a function defined by the following expression:

$$\mathrm{Gamma}[x]=D_{GC}^{MAX}\cdot(x/D_{IN}^{MAX})^{\gamma}. \tag{9}$$

It should be noted that there is a difference between Equations (8a) and (8b) in the expression for calculation of the correction point data CP1.

Figure 4A:
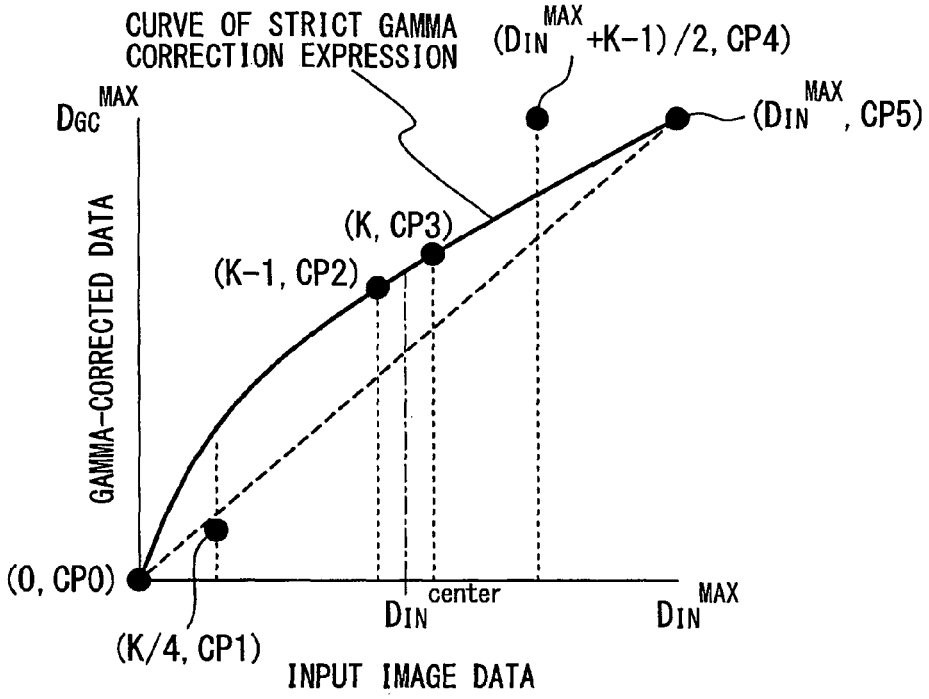
FIG. 4A is a graph showing a gamma curve achieved by the arithmetic expression in a case where the gamma value of the gamma correction is smaller than one.

FIG. 4A is a graph showing the relation between the correction point data CP0-CP5 and the shape of the gamma curve for a case where γ<1 in a coordinate system in which the horizontal axis represents the input image data $D_{IN}$ and the vertical axis represents the gamma-corrected data $D_{GC}$. For γ<1, determining the correction point data CP0-CP5 in accordance with Expression (8a) and calculating the gamma-corrected data $D_{GC}$ by Expressions (3a) and (3c) result in that the gamma-corrected data $D_{GC}$ obtained by the strict expression given in Expression (1) is identical to the gamma-corrected data $D_{GC}$ obtained by Expressions (3a) and (3b) for four cases where the input image data $D_{IN}$ are zero, K/4, $(D_{IN}^{MAX}+K-1)$ and $D_{IN}^{MAX}$.

Figure 4B:
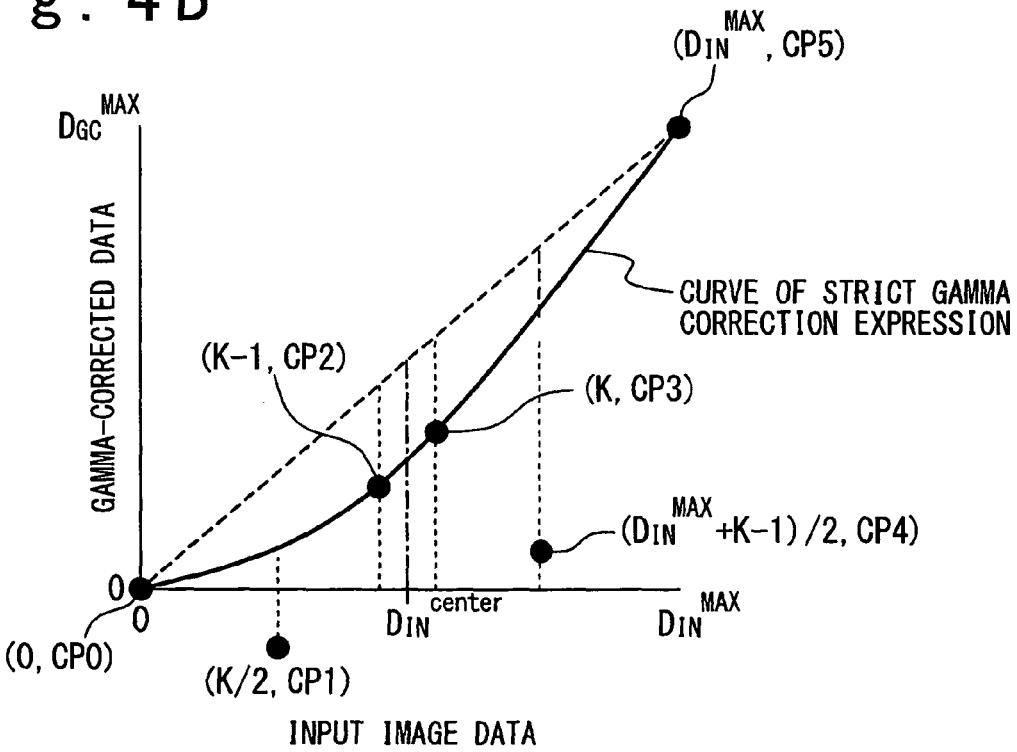
FIG. 4B is a graph showing a gamma curve achieved by the arithmetic expression in a case where the gamma value of the gamma correction is smaller than one.

On the other hand, FIG. 4B is a graph showing the relation between the correction point data CP0-CP5 and the shape of the gamma curve for a case where γ>1. For γ<1, determining the correction point data CP0-CP5 in accordance with Expression (8b) and calculating the gamma-corrected data $D_{GC}$ by Expressions (3b) and (3c) result in that the gamma-corrected data $D_{GC}$ obtained by the strict expression given in Expression (1) is identical to the gamma-corrected data $D_{GC}$ obtained by Expressions (3a) and (3b) for four cases where the input image data $D_{IN}$ are zero, K/2, $(D_{IN}^{MAX}+K-1)$ and $D_{IN}^{MAX}$.

It should be noted that the above-described gamma correction processing is disclosed in Japanese Patent Application Publication No. 2007-072085 A (or Japanese Patent No. 4086868 B).

Referring to FIGS. 4A and 4B, the correction point data CP1 specifies a control point positioned in a range where the input image data $D_{IN}$ range from zero to the intermediate data value $D_{IN}^{Center}$, for both cases of γ<1 and γ>1. Therefore, modifying the correction point data CP1 allows modifying the shape of the gamma curve in the range from zero to the intermediate data value $D_{IN}^{Center}$. On the other hand, the correction point data CP4 specifies a control point positioned in a range where the input image data $D_{IN}$ range from the intermediate data value $D_{IN}^{Center}$ to $D_{IN}^{MAX}$. Therefore, modifying the correction point data CP4 allows modifying the shape of the gamma curve in the range from the intermediate data value $D_{IN}^{Center}$ to $D_{IN}^{MAX}$.

It should be noted that the gamma value γ used in Expression (9) is different for R, G and B. The correction point data CP0-CP5 are calculated with different gamma values γ for R, G and B.

2. Contrast Enhancement Operation

Figure 5:
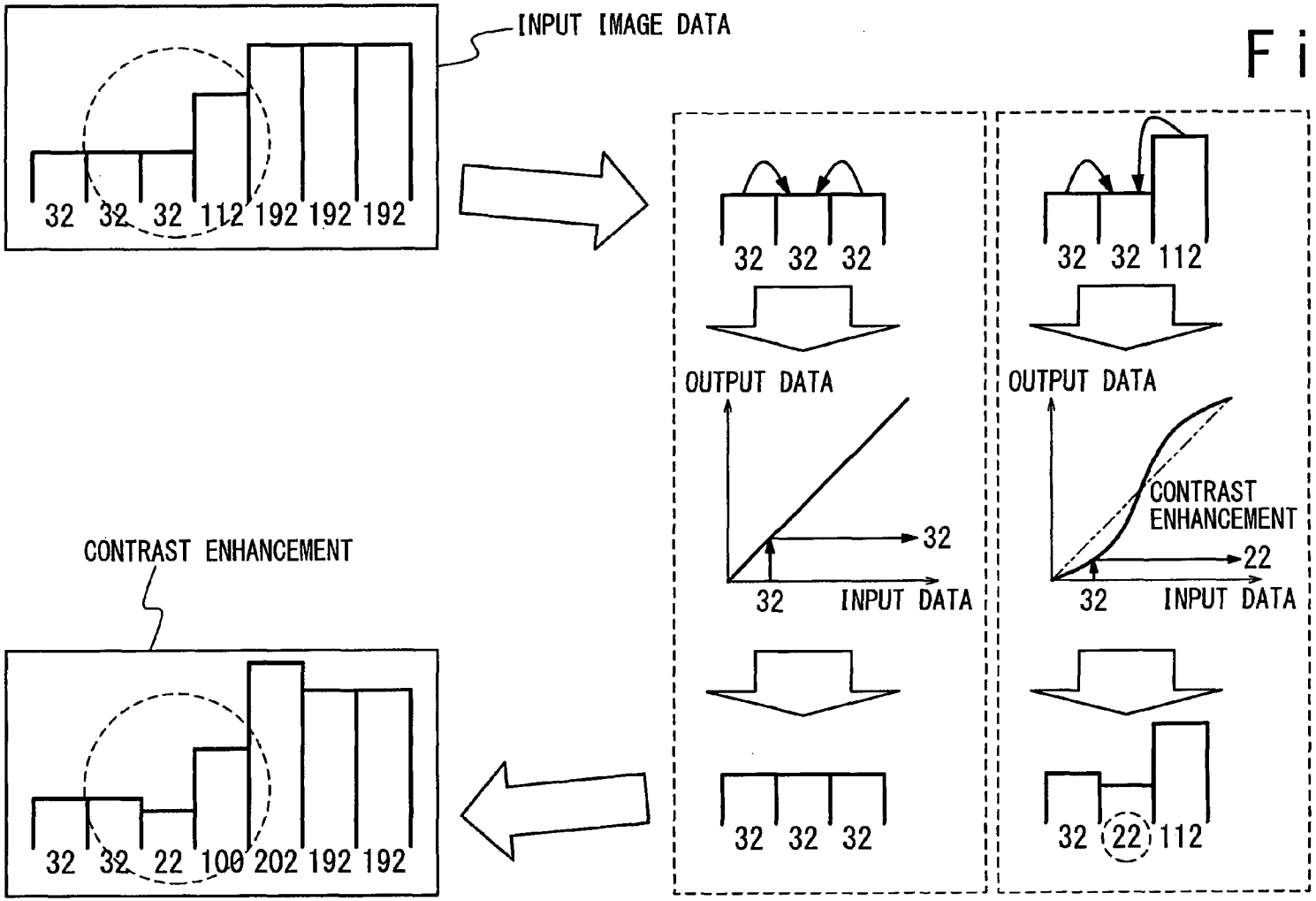
FIG. 5 is a diagram schematically showing contrast enhancement processing.

FIG. 5 is a diagram showing the contrast enhancement processing to be performed in this embodiment. In this embodiment, the value of input image data $D_{IN}$ associated with a pixel of interest (target pixel) is modified in response to the difference between the grayscale value (or the value of the input image data $D_{IN}$) of each sub-pixel of the target pixel and the grayscale values of the corresponding sub-pixels of the pixels adjacent to the target pixel, to thereby enhance the contrast of the image.

Let us consider a case where a data series of "32", "32", "32", "112", "192", "192" and "192" are inputted as the input image data $D_{IN}$ of the R sub-pixels, for example. For a partial data series of "32", "32", and "112" included in the data series, the processing is performed on the second data "32" for increasing the difference from the adjacent data "112". That is, the second data "32" are corrected to "22" for example. For a partial data series of "32", "32" and "32", on the other hand, the second data "32" are not corrected, since the differences between the second data "32" and the data adjacent thereto are zero. Discussed in the following is a method for performing such contrast enhancement in the approximate correction circuit 31, which is originally configured to perform the gamma correction.

3. Contrast Enhancement by Modification of Correction Point Data CP1 and CP4

Although a general controller driver performs the gamma correction and the contrast enhancement with separate circuits, the controller driver 3 of this embodiment is designed to modify the shape of the gamma curve by modifying the correction point data CP1 and CP4 to thereby simultaneously perform the gamma correction and the contrast enhancement. In the following, a description is given of contrast enhancement processing based on modification of the correction point data CP1 and CP4.

Figure 6:
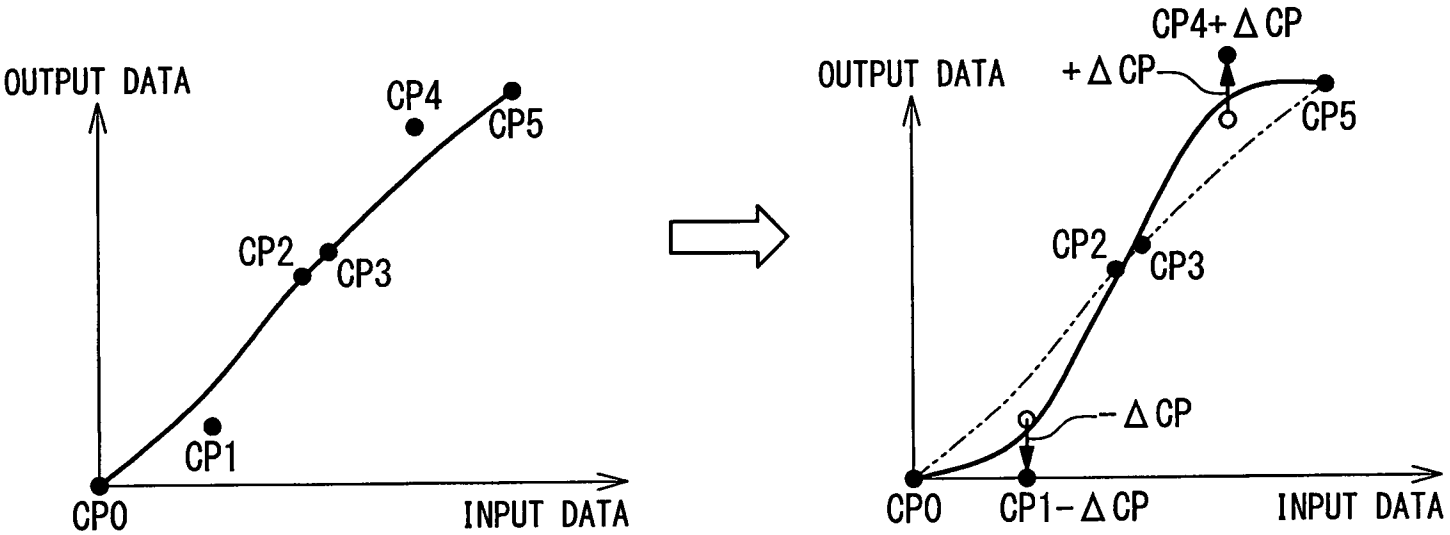
FIG. 6 is a diagram schematically showing contrast enhancement processing by modifying the correction point data in the first embodiment.

FIG. 6 is a diagram showing the contrast enhancement based on modification of the correction point data CP1 and CP4. The correction point data CP1 and CP4 are modified in response to the difference data ΔCP received from the difference data calculation circuit 13. The modification amounts of the correction point data CP1 and CP4 are specified by the difference data ΔCP. Here, the difference data ΔCP are calculated in response to the differences between the grayscale level (the value of the input image data $D_{IN}$) of each sub-pixel of the target pixel and the grayscale levels of the corresponding sub-pixels of the pixels adjacent to the target pixel.

More specifically, the difference data ΔCP for the R sub-pixel, the G sub-pixel and the B sub-pixels of the target pixel are calculated by the following expressions, respectively:

$$\Delta CP_R=\alpha^{R}\cdot(|D_{IN}^{R}-D_{INL}^{R}|+|D_{IN}^{R}-D_{INR}^{R}|)/2, \tag{10a}$$

$$\Delta CP_G=\alpha^{G}\cdot(|D_{IN}^{G}-D_{INL}^{G}|+|D_{IN}^{G}-D_{INR}^{G}|)/2, \text{ and} \tag{10b}$$

$$\Delta CP_B=\alpha^{B}\cdot(|D_{IN}^{B}-D_{INL}^{B}|+|D_{IN}^{B}-D_{INR}^{B}|)/2, \tag{10c}$$

where $D_{IN}^{R}$, $D_{IN}^{G}$ and $D_{IN}^{B}$ are grayscale levels of the R sub-pixel, the G sub-pixel and the B sub-pixel of the target pixel, respectively, $D_{INR}^{R}$, $D_{INR}^{G}$ and $D_{INR}^{B}$ are grayscale levels of the R sub-pixel, the G sub-pixel and the B sub-pixel of the pixel adjacent on the right to the target pixel, respectively, and $D_{INL}^{R}$, $D_{INL}^{G}$ and $D_{INL}^{B}$ are grayscale levels of the R sub-pixel, the G sub-pixel and the B sub-pixel of the pixel adjacent on the left to the target pixel, respectively.

Furthermore, the adder-subtracter units 33R, 33G and 33B modify the correction point data CP1_R, CP4_R, CP1_G, CP4_G, CP1_B and CP4_B by the following calculations:

$$CP1_R'=CP1_R-\Delta CP_R, \tag{11a}$$

$$CP4_R'=CP4_R+\Delta CP_R, \tag{11b}$$

$$CP1_G'=CP1_G-\Delta CP_G, \tag{11c}$$

$$CP4_G'=CP4_G+\Delta CP_G \tag{11d}$$

$$CP1_B'=CP1_B-\Delta CP_B, \text{ and} \tag{11e}$$

$$CP4_B'=CP4_B+\Delta CP_B. \tag{11f}$$

Such calculations result in that the difference in the positions of the control points specified by the correction point data CP1 and CP4 in the direction of the vertical axis (corresponding to the gamma-corrected data) is increased with increases in the differences between the grayscale level of each sub-pixel of the target pixel and the grayscale levels of the corresponding sub-pixels of the pixels adjacent to the target pixel, as shown in the right figure of FIG. 6 and the shape of the gamma curve is modified accordingly. This effectively achieves contrast enhancement in parallel with the gamma correction.

As a result of the modifications of the correction point data CP1 and CP4, the gamma-corrected data $D_{GC}^{R}$, $D_{GC}^{G}$ and $D_{GC}^{B}$ are eventually calculated by the following expressions:

(1) When the input image data $D_{IN}^{R}$, $D_{IN}^{G}$ and $D_{IN}^{B}$ are smaller than the intermediate data value $D_{IN}^{Center}$ and the gamma value γ is less than one, $$D_{GC}^{R}=\frac{2(CP1_R'-CP0_R)\cdot PD_{INS}}{K^2}+\frac{(CP3_R-CP0_R)D_{INS}}{K}+CP0_R, \tag{12a}$$

$$D_{GC}^{G}=\frac{2(CP1_G'-CP0_G)\cdot PD_{INS}}{K^2}+\frac{(CP3_G-CP0_G)D_{INS}}{K}+CP0_G, \tag{12b}$$

$$D_{GC}^{B}=\frac{2(CP1_B'-CP0_B)\cdot PD_{INS}}{K^2}+\frac{(CP3_B-CP0_B)D_{INS}}{K}+CP0_B. \tag{12c}$$

(2) When the input image data $D_{IN}^{R}$, $D_{IN}^{G}$ and $D_{IN}^{B}$ are smaller than the intermediate data value $D_{IN}^{Center}$ and the gamma value γ is equal to or more than one, $$D_{GC}^{R}=\frac{2(CP1_R'-CP0_R)\cdot ND_{INS}}{K^2}+\frac{(CP3_R-CP0_R)D_{INS}}{K}+CP0_R, \tag{13a}$$

$$D_{GC}^{G}=\frac{2(CP1_G'-CP0_G)\cdot ND_{INS}}{K^2}+\frac{(CP3_G-CP0_G)D_{INS}}{K}+CP0_G, \tag{13b}$$

$$D_{GC}^{B}=\frac{2(CP1_B'-CP0_B)\cdot ND_{INS}}{K^2}+\frac{(CP3_B-CP0_B)D_{INS}}{K}+CP0_B. \tag{13c}$$

(3) When the input image data $D_{IN}^{R}$, $D_{IN}^{G}$ and $D_{IN}^{B}$ are equal to or larger than the intermediate data value $D_{IN}^{Center}$, $$D_{GC}^{R}=\frac{2(CP4_R'-CP2_R)\cdot ND_{INS}}{K^2}+\frac{(CP5_R-CP2_R)D_{INS}}{K}+CP2_R. \tag{14a}$$

$$D_{GC}^{G}=\frac{2(CP4_G'-CP2_G)\cdot ND_{INS}}{K^2}+\frac{(CP5_G-CP2_G)D_{INS}}{K}+CP2_G. \tag{14b}$$

$$D_{GC}^{B}=\frac{2(CP4_B'-CP2_B)\cdot ND_{INS}}{K^2}+\frac{(CP5_B-CP2_B)D_{INS}}{K}+CP2_B. \tag{14c}$$

It should be noted here that $D_{INS}$, $PD_{INS}$ and $ND_{INS}$ are also calculated from the input image data $D_{IN}^{R}$, $D_{IN}^{G}$ and $D_{IN}^{B}$ of the R, G and B sub-pixels of the target pixel by using Equations (5a), (5b), (6a), (6b) and (7).

As described above, the shape of the gamma curve used in the gamma correction of the input image data $D_{IN}^{R}$, $D_{IN}^{G}$ and $D_{IN}^{B}$ of the respective sub pixels of the target pixel is modified in response to the difference in the grayscale level (or the value of the input image data $D_{IN}$) between the respective sub-pixels of the target pixel and the corresponding sub-pixels of the adjacent pixels in this embodiment. This allows simultaneously performing gamma correction and contrast enhancement, effectively reducing hardware.

Second Embodiment

Figure 7:
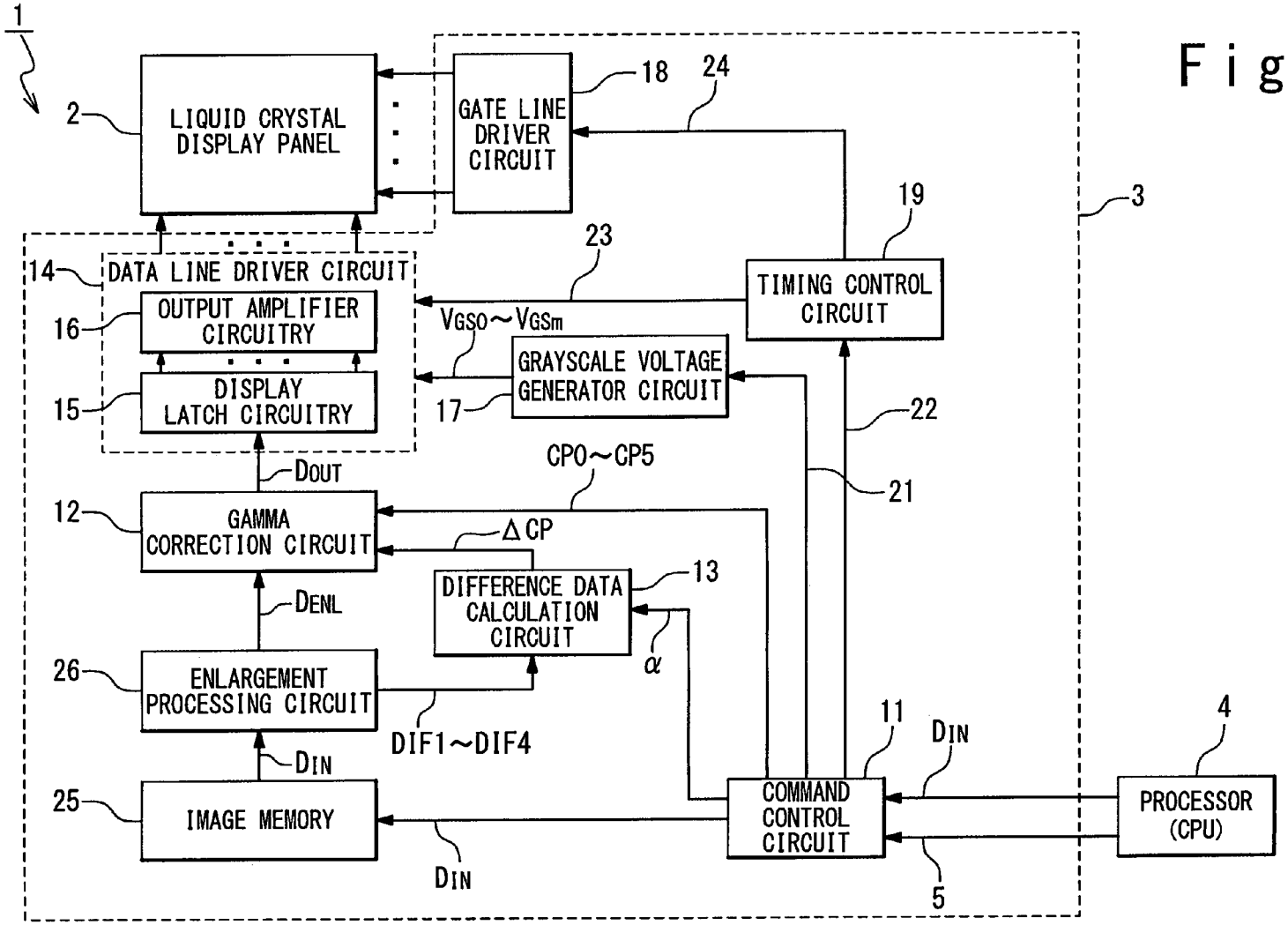
FIG. 7 is a block diagram showing an exemplary configuration of a liquid crystal display device in a second embodiment of the present invention.

FIG. 7 is a block diagram showing an exemplary configuration of the liquid crystal display device 1 in a second embodiment of the present invention. In the second embodiment, enlargement processing is performed for enlarging the image of the input image data $D_{IN}$ by a factor of two in both of the vertical and horizontal directions. More specifically, image data for 2×2 pixels (enlarged data $D_{ENL}$) are generated from input image data $D_{IN}$ for one pixel, and the gamma correction is performed on the enlarged data $D_{ENL}$ by the gamma correction circuit 12.

In detail, the controller driver 3 additionally includes an image memory 25 and an enlargement processing circuit 26. The image memory 25 temporarily stores the input image data $D_{IN}$ and forwards the stored input image data $D_{IN}$ to the enlargement processing circuit 26. The image memory 25 is configured to store the input image data $D_{IN}$ for at least one line of pixels (pixels connected to one gate line). The enlargement processing circuit 26 generates enlarged data $D_{ENL}$ for 2×2 pixels and grayscale differential data DIF from input image data $D_{IN}$ for one pixel. The grayscale differential data DIF are indicative of differences between corresponding sub-pixels of adjacent pixels in the enlarged image. In the second embodiment, gamma correction processing is performed by the gamma correction circuit 12 on the enlarged data $D_{ENL}$ instead of the input image data $D_{IN}$. In addition, the difference data ΔCP are generated from the grayscale differential data DIF instead of the input image data $D_{IN}$.

Figure 8:
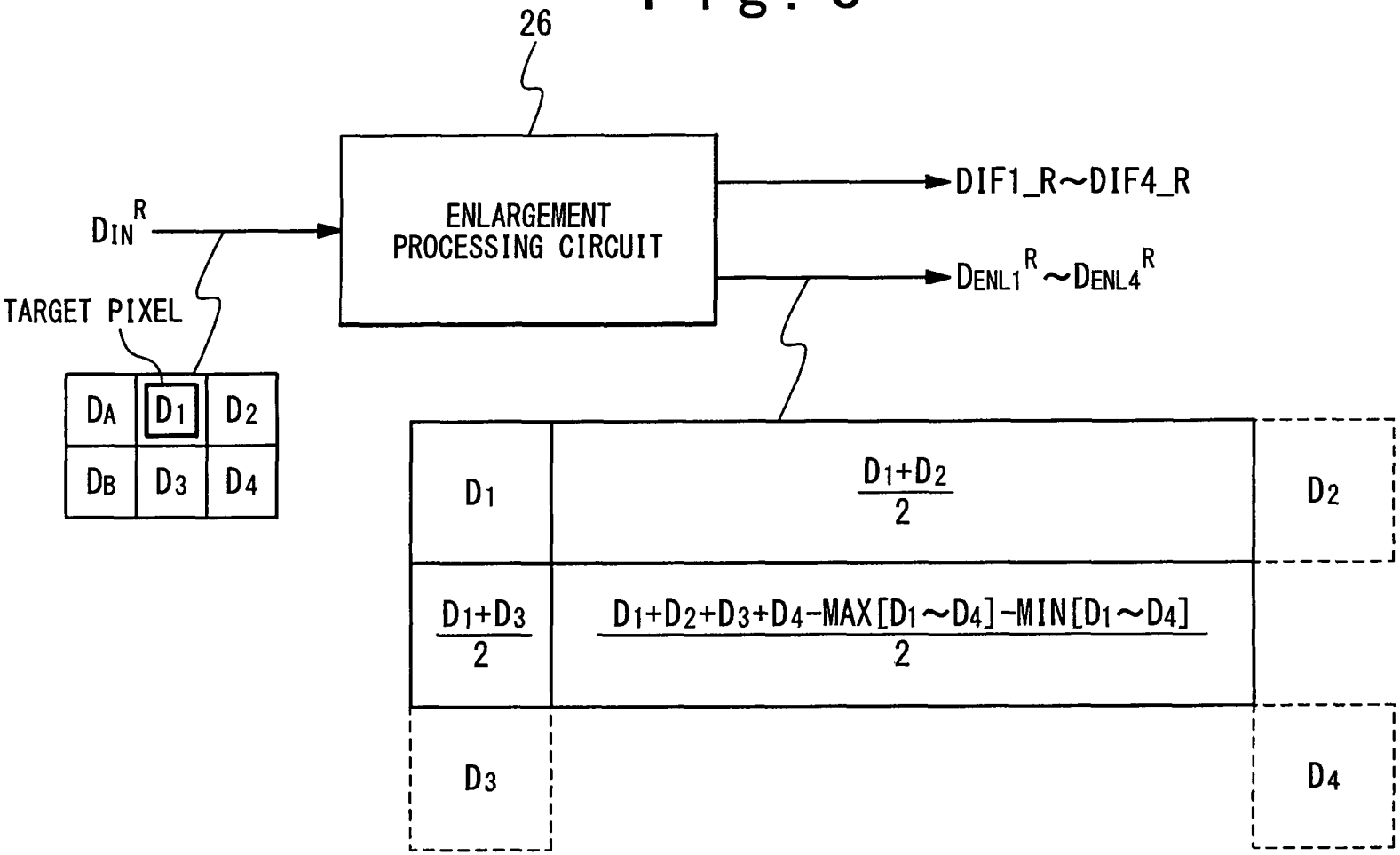
FIG. 8 is a diagram showing an operation of an enlargement processing circuit.

FIG. 8 is a diagram schematically showing an exemplary operation of the enlargement processing circuit 26 in the second embodiment. In the following, a description is given of enlargement processing for the input image data $D_{IN}^R$ of the R sub-pixels.

When receiving input image data $D_{IN}^R$ of the R sub-pixels of 2×2 pixels (pixels arrayed in two columns and two rows) including the target pixel and input image data $D_{IN}^R$ of the R sub-pixel of the pixel adjacent on the left to the target pixel, the enlargement processing circuit 26 generates enlarged data $D_{ENL1}^R$-$D_{ENL4}^R$ indicative of the grayscale levels of the R sub-pixels of 2×2 pixels associated with the target pixel in the enlarged image in accordance with the following expressions:

$$D_{ENL1}^R=D_1 \tag{15a}$$

$$D_{ENL2}^R=(D_1+D_2)/2 \tag{15b}$$

$$D_{ENL3}^R=(D_1+D_3)/2, \text{ and} \tag{15c}$$

$$D_{ENL4}^R=(D_1+D_2+D_3+D_4-\mathrm{MAX}[D_1-D_4]-\mathrm{MIN}[D_1-D_4])/2, \tag{15d}$$

where $D_1$ is the input image data $D_{IN}^R$ of the R sub-pixel of the target pixel in the original image; $D_2$ is the input image data $D_{IN}^R$ of the R sub-pixel of the pixel adjacent on the right to the target pixel in the original image; $D_3$ is the input image data $D_{IN}^R$ of the R sub-pixel of the pixel adjacent below to the target pixel in the original image; $D_4$ is the input image data $D_{IN}^R$ of the R sub-pixel of the pixel adjacent on the lower right to the target pixel in the original image; $D_{ENL1}^R$ is the enlarged data of the R sub-pixel of the upper left pixel out of the 2×2 pixels associated with the target pixel in the enlarged image; $D_{ENL2}^R$ is the enlarged data of the R sub-pixel of the upper right pixel out of the 2×2 pixels associated; $D_{ENL3}^R$ is the enlarged data of the R sub-pixel of the lower left pixel out of the 2×2 pixels associated; $D_{ENL4}^R$ is the enlarged data of the R sub-pixel of the lower right pixel out of the 2×2 pixels associated; MAX[$D_1$-$D_4$] is the maximum value out of $D_1$-$D_4$; and MIN[$D_1$-$D_4$] is the maximum value out of $D_1$-$D_4$.

The enlargement processing circuit 26 further generates grayscale differential data DIF_R indicative of the differences in the grayscale level between R) sub-pixels of adjacent pixels in the enlarged image:

$$DIF1_R=(|D_1-D_A|+|D_1-D_2|)/2, \tag{16a}$$

$$DIF2_R=|D_1-D_2|, \tag{16b}$$

$$DIF3_R=|D_1-D_3|, \text{ and} \tag{16c}$$

$$DIF4_R=(|D_{ENL4}^R-D_1|+|D_{ENL4}^R-D_2|+|D_{ENL4}^R-D_3|+|D_{ENL4}^R-D_4|-|D_{ENL4}^R-\mathrm{MAX}[D_1\sim D_4]|-|D_{ENL4}^R-\mathrm{MAX}[D_1\sim D_4]|)/2, \tag{16d}$$

where $D_A$ is the input image data $D_{IN}^R$ of the R sub-pixel of the pixel on the left to the target pixel in the original image; DIF1_R is grayscale differential data associated with the R sub-pixel of the upper left pixel out of 2×2 pixels associated with the target pixel in the enlarged image; DIF2_R is grayscale differential data associated with the R sub-pixel of the upper right pixel out of the 2×2 pixels; DIF3_R is grayscale differential data associated with the R sub-pixel of the lower left pixel out of the 2×2 pixels; and DIF4_R is grayscale differential data associated with the R sub-pixel of the lower right pixel out of the 2×2 pixels.

Similar processing is applied to the input image data $D_{IN}^G$ of the G sub-pixel of the target pixel and the input image data $D_{IN}^B$ of the B sub-pixel to generate enlarged data $D_{ENL1}^G$-$D_{ENL4}^G$, $D_{ENL1}^B$-$D_{ENL4}^B$, grayscale differential data DIF1_G-DIF4_G and DIF1_B-DIF1_B.

The grayscale differential data DIF1_-DIF4_generated for the R, G and B sub-pixels are fed to the difference data calculation circuit 13 to calculate the difference data ΔCP. In this embodiment, the difference data calculation circuit 13 calculates the difference data ΔCP by the following expressions:

$$\Delta CP_R=\alpha^R\cdot DIFk_R, \tag{17a}$$

$$\Delta CP_G=\alpha^G\cdot DIFk_G, \text{ and} \tag{17b}$$

$$\Delta CP_B=\alpha^B\cdot DIFk_B, \tag{17c}$$

where DIFk_R means that DIF1_R is used for the upper left pixel of the 2×2 pixels in the enlarged image, DIF2_R for the upper right pixel, DIF2_R for the lower left pixel and DIF2_R for the lower right pixel. The same goes for DIFk_G and DIFk_B. The calculated difference data ΔCP_R, ΔCP_G and ΔCP_B are fed to the gamma correction circuit 12 and used for modifications of the correction point data CP1_R, CP4_R, CP1_G, CP4_G, CP1_B and CP4_B.

On the other hand, the enlarged data $D_{ENL1}^R$-$D_{ENL4}$ $D_{ENL1}^G$-$D_{ENL4}^G$ and $D_{ENL1}^B$-$D_{ENL4}^B$ are fed to the gamma corrected circuit 12. The gamma correction circuit 12 performs gamma correction and contrast enhancement on the enlarged data $D_{ENL1}^R$-$D_{ENL4}^R$, $D_{ENL1}^G$-$D_{ENL4}^G$ and $D_{ENL1}^B$-$D_{ENL4}^B$ to generate gamma-corrected data $D_{GC}^R$, $D_{GC}^G$ and $D_{GC}^B$. Furthermore, the gamma correction circuit 12 performs color reduction on the gamma-corrected data $D_{GC}^R$, $D_{GC}^G$ and $D_{GC}^B$ to generate output image data $D_{OUT}^R$, $D_{OUT}^G$ and $D_{OUT}^B$. The processing performed in the gamma correction circuit 12 is almost same as that in the first embodiment, except for that the enlarged data $D_{ENL1}^R$-$D_{ENL4}^R$ are used in place of the input image data $D_{IN}^R$, the enlarged data $D_{ENL1}^G$-$D_{ENL4}^G$ are used in place of the input image data $D_{IN}^G$ and the enlarged data $D_{ENL1}^B$-$D_{ENL4}^B$ are used in place of the input image data $D_{IN}^B$.

As described above, contract enhancement is achieved by modifying the correction point data CP1 and CP4 also in the second embodiment. Here, the gamma correction and the contrast enhancement is simultaneously performed in the gamma correction circuit 12 to thereby reduce hardware.

It would be apparent that the present invention is not limited to the above-described embodiments, which may be modified and changed without departing from the scope of the invention. For example, although embodiments of liquid crystal display devices are described above, it would be apparent to the person skilled in the art that the present invention is applicable to display devices using other display panels.

What is claimed is:

1. A display device, comprising:

a display panel;

a correction circuit performing gamma correction on target image data in response to correction data specifying a shape of a gamma curve; and a driver circuit driving said display panel in response to gamma-corrected data received from said correction circuit, wherein said correction circuit is configured to performs approximate gamma correction on said target image data in accordance with a correction expression in which said target image data are defined as a variable of said correction expression and coefficients of said correction expression are determined on said correction data, and to modify said correction data associated with the target pixel in response to differences between said target image data associated with the target pixel and pixels physically adjacent to said target pixel in the display panel, wherein said correction data include: first and second correction point data which specify positions of first and second control points specifying the shape of said gamma curve, and wherein said correction circuit modifies said first and second correction point data so that a difference between coordinates of said first and second control points on a coordinate axis corresponding to said gamma-corrected data in a coordinate system in which said gamma curve is defined is increased as the differences of between said target image data associated with the target pixel and pixels physically adjacent to said target pixel is increased.

2. The display device according to claim 1, further comprising a control circuitry feeding said correction data, wherein said correction data include correction point data CP0-CP5, said correction point data CP1 being said first correction point data and said correction point data CP4 being said second correction point data, wherein, in a case where $D_{IN}$ is defined as said target image data, $D_{GC}$ is defined as said gamma-corrected data and an intermediate data value $D_{IN}^{Center}$ is defined with an allowed maximum value $D_{IN}^{MAX}$ of said target image data by the following expression (1):

$$D_{IN}^{Center}=D_{IN}^{MAX}/2, \tag{1}$$

when said target image data $D_{IN}$ are smaller than said intermediate data value $D_{IN}^{Center}$ and said correction point data CP0-CP5 are determined so that a gamma value of said gamma correction is less than one, said gamma-corrected data $D_{GC}$ are calculated by the following expression (2a):

$$D_{GC} = \frac{2(CP1 - CP0)\cdot PD_{INS}}{K^2} + \frac{(CP3 - CP0)D_{INS}}{K} + CP0, \tag{2a}$$

when said target image data $D_{IN}$ are smaller than said intermediate data value $D_{IN}^{Center}$ and said correction point data CP0-CP5 are determined so that the gamma value of said gamma correction is more than one, said gamma-corrected data $D_{GC}$ are calculated by the following expression (2b):

$$D_{GC} = \frac{2(CP1 - CP0)\cdot ND_{INS}}{K^2} + \frac{(CP3 - CP0)D_{INS}}{K} + CP0, \tag{2b}$$

wherein, when said target image data $D_{IN}$ are larger than said intermediate data value $D_{IN}^{Center}$, said gamma-corrected data $D_{GC}$ are calculated by the following expression (2c):

$$D_{GC} = \frac{2(CP4 - CP2)\cdot ND_{INS}}{K^2} + \frac{(CP5 - CP2)D_{INS}}{K} + CP2, \tag{2c}$$

wherein said correction circuit modifies said correction point data CP1 and CP4 in response to said target image data associated with a target pixel of said gamma correction and an pixel adjacent to said target pixel, and wherein K, $D_{INS}$, $PD_{INS}$ and $ND_{INS}$ are value defined by the following expressions:

$K=(D_{IN}^{MAX}+1)/2,$ $D_{INS}=D^{IN}$,(for $D_{IN}<D_{IN}^{Center}$)

$D_{INS}=D_{IN}+1-K$,(for $D_{IN}>D_{IN}^{Center}$)

$PD_{INS}=(K-R)\cdot R$, and $ND_{INS}=(K-D_{INS})\cdot D_{INS}$, where R is a parameter defined by the following expression:

$R=K^{1/2}\cdot(D_{INS}))^{1/2}.$

3. The display device according to claim 2, wherein, when said gamma value is less than one, said correction points data CP0-CP5 are calculated by the following expression (3a):

$$\begin{aligned} CP0 &= 0, \\ CP1 &= \frac{4\cdot \mathrm{Gamma}[K/4] - \mathrm{Gamma}[K]}{2}, \\ CP2 &= \mathrm{Gamma}[K-1], \\ CP3 &= \mathrm{Gamma}[K], \\ CP4 &= 2\cdot \mathrm{Gamma}[(D_{IN}^{MAX} + K - 1)/2] - D_{GC}^{MAX}, \\ CP5 &= D_{GC}^{MAX}, \end{aligned} \tag{3a}$$

where $D_{GC}^{MAX}$ is an allowed maximum value of said gamma-corrected data, and wherein, when said gamma value is more than one, said correction points data CP0-CP5 are calculated by the following expression (3b):

$CP0=0,$ $CP1=2\cdot\mathrm{Gamma}[K/2]-\mathrm{Gamma}[K],$ $$CP2=\text{Gamma}[K-1],$$

$$CP3=\text{Gamma}[K]$$

$$CP4=2\cdot\text{Gamma}[(D_{IN}^{MAX}+K-1)/2]-D_{GC}^{MAX},$$

$$CP5=D_{GC}^{MAX}, \quad (3b)$$

where Gamma[x] is a function defined with an allowed maximum value $D_{GC}^{MAX}$ of said gamma-corrected data by the following expression:

$$\text{Gamma}[x]=D_{GC}^{MAX}\cdot(x/D_{IN}^{MAX})^{\gamma}, \quad (4)$$

and γ is the gamma value.

4. The display device according to claim 1, further comprising:

an enlargement processing circuit externally receiving input image data of an input image and generating image data of an enlarged image of said input image as said target image data; and a difference data calculation circuit feeding difference data indicative of modification amounts of said first and second correction points data to said correction circuit, wherein said enlargement processing circuit generates grayscale differential data from said input image data, said grayscale differential data indicating differences between grayscale levels of said target pixel and said pixels adjacent to said target pixel, and wherein said difference data calculation circuit generates said difference data from said grayscale differential data.

5. The display device according to claim 1, wherein said correction circuit is configured to simultaneously perform the gamma correction and a contrast enhancement through performing the approximate gamma correction on said target image data.

6. The display device according to claim 1, wherein said correction circuit further comprises an approximate correction circuit, the approximate correction circuit is configured to simultaneously perform the gamma correction and a contrast enhancement through performing the approximate gamma correction on said target image data.

7. The display device according to claim 1, wherein the gamma correction and a contrast enhancement are simultaneously performed by modifying a shape of a gamma curve used in the gamma correction of an input image data of a specific pixel in response to a difference between values of the input image data of the specific pixel and an adjacent pixel.

8. The display device according to claim 7, wherein a modification of the shape of the gamma curve is achieved by modifying values of correction point data in response to a difference between the values of the input image data of the specific pixel and the adjacent pixel.

9. The display device according to claim 1, wherein the correction circuit is configured to perform the gamma correction and the contract enhancement simultaneously by modifying the shape of the gamma curve used in the gamma correction of the input image data of the target pixel in response to a difference between values of the input image data of the target pixel and an adjacent pixel.

10. The display device according to claim 9, wherein the correction circuit is configured to modify the shape of the gamma curve by modifying the values of correction point data in response to the difference between the values of the input image data of the target pixel and the adjacent pixel.

11. The display device according to claim 1, wherein the difference in positions of the first and second control points in a direction of a vertical axis corresponding to the gamma-corrected data is increased with increases in the differences between grayscale level of each sub-pixel of the target pixel and grayscale levels of corresponding sub-pixels of the pixels adjacent to the target pixel, to modify a shape of a gamma curve to provide contrast enhancement in parallel with the gamma correction.

12. The display device according to claim 1, wherein a shape of a gamma curve used in the gamma correction of input image data of respective sub pixels of the target pixel is modified in response to a difference in grayscale level between the respective sub-pixels of the target pixel and the corresponding sub-pixels of the adjacent pixels.

13. A display panel driver, comprising:

a correction circuit performing gamma correction on target image data in response to correction data specifying a shape of a gamma curve; and a driver circuit driving a display panel in response to gamma-corrected data received from said correction circuit, wherein said correction circuit is configured to performs approximate gamma correction on said target image data in accordance with a correction expression in which said target image data are defined as a variable of said correction expression and coefficients of said correction expression are determined on said correction data, and to modify said correction data associated with the target pixel in response to differences between said target image data associated with the target pixel and pixels physically adjacent to said target pixel in the display panel, wherein said correction data include: first and second correction point data which specify positions of first and second control points specifying the shape of said gamma curve, and wherein said correction circuit modifies said first and second correction point data so that a difference between coordinates of said first and second control points on a coordinate axis corresponding to said gamma-corrected data in a coordinate system in which said gamma curve is defined is increased as the differences of between said target image data associated with the target pixel and pixels physically adjacent to said target pixel is increased.

14. The display panel driver according to claim 13, wherein said correction circuit is configured to simultaneously perform the gamma correction and a contrast enhancement through performing the approximate gamma correction on said target image data.

15. The display panel driver according to claim 13, wherein said correction circuit further comprises an approximate correction circuit, the approximate correction circuit is configured to simultaneously perform the gamma correction and a contrast enhancement through performing the approximate gamma correction on said target image data.

16. The display panel driver according to claim 13, wherein the gamma correction and a contrast enhancement are simultaneously performed by modifying a shape of a gamma curve used in the gamma correction of an input image data of a specific pixel in response to a difference between values of the input image data of the specific pixel and an adjacent pixel.

17. The display panel driver according to claim 16, wherein a modification of the shape of the gamma curve is achieved by modifying values of correction point data in response to a difference between the values of the input image data of the specific pixel and the adjacent pixel.

18. An image data processing apparatus, comprising:

a correction unit performing gamma correction on target image data in response to correction data specifying a shape of a gamma curve to generate gamma-corrected data; and a correction data modification unit, wherein said correction unit is configured to performs approximate gamma correction on said target image data in accordance with a correction expression in which said target image data are defined as a variable of said correction expression and coefficients of said correction expression are determined on said correction data, and wherein said correction data modification unit is configured to modify said correction data associated with the target pixel in response to differences between said target image data associated with the target pixel and pixels physically adjacent to said target pixel in the display panel, wherein said correction data include: first and second correction point data which specify positions of first and second control points specifying the shape of said gamma curve, and wherein said correction circuit modifies said first and second correction point data so that a difference between coordinates of said first and second control points on a coordinate axis corresponding to said gamma-corrected data in a coordinate system in which said gamma curve is defined is increased as the differences of between said target image data associated with the target pixel and pixels physically adjacent to said target pixel is increased.

19. The image data processing apparatus according to claim 18, wherein said correction circuit further comprises an approximate correction circuit, the approximate correction circuit is configured to simultaneously perform the gamma correction and a contrast enhancement through performing the approximate gamma correction on said target image data.

20. The image data processing apparatus according to claim 18, wherein the gamma correction and a contrast enhancement are simultaneously performed by modifying a shape of a gamma curve used in the gamma correction of an input image data of a specific pixel in response to a difference between values of the input image data of the specific pixel and an adjacent pixel.

21. The image data processing apparatus according to claim 20, wherein a modification of the shape of the gamma curve is achieved by modifying values of correction point data in response to a difference between the values of the input image data of the specific pixel and the adjacent pixel.

* * * * *